US008910486B2

(12) United States Patent
Bin-Nun et al.

(10) Patent No.: US 8,910,486 B2
(45) Date of Patent: Dec. 16, 2014

(54) EXPANDER FOR STIRLING ENGINES AND CRYOGENIC COOLERS

(75) Inventors: Uri Bin-Nun, Chelmsford, MA (US); Jose Pascual Sanchez, Lawrence, MA (US); Xiaoyuan Lei, Boxborough, MA (US); Usha Virk, Wellesley, MA (US)

(73) Assignee: FLIR Systems, Inc., Wilsonville, OR (US)

( * ) Notice: Subject to any disclaimer, the term of this patent is extended or adjusted under 35 U.S.C. 154(b) by 1013 days.

(21) Appl. No.: 12/841,280

(22) Filed: Jul. 22, 2010

(65) Prior Publication Data

US 2012/0017607 A1 Jan. 26, 2012

(51) Int. Cl.

| | |
|---|---|
| ***F25B 9/00*** | (2006.01) |
| ***F25B 19/02*** | (2006.01) |
| ***F25B 9/14*** | (2006.01) |

(52) U.S. Cl.

CPC ..... *F25B 9/14* (2013.01); *F25B 2309/003* (2013.01); *F02G 2250/31* (2013.01)

USPC ..... 62/6; 62/51.2

(58) Field of Classification Search

USPC ..... 62/6, 51.2

See application file for complete search history.

(56) References Cited

U.S. PATENT DOCUMENTS

| | | | | |
|---|---|---|---|---|
| 3,074,244 A | | 1/1963 | Malaker et al. | |
| 3,537,516 A | * | 11/1970 | Kunz | 165/181 |
| 3,742,719 A | | 7/1973 | Lagodmos | |
| 4,019,336 A | * | 4/1977 | Mijnheer et al. | 62/6 |
| 4,024,727 A | | 5/1977 | Berry et al. | |
| 4,231,418 A | | 11/1980 | Lagodmos | |
| 4,291,547 A | | 9/1981 | Leo | |
| 4,310,337 A | * | 1/1982 | Sarcia | 62/6 |
| 4,365,982 A | | 12/1982 | Durenec | |

(Continued)

FOREIGN PATENT DOCUMENTS

| | | |
|---|---|---|
| CN | 1975289 A | 6/2007 |
| DE | 10 2004 060819 B3 | 4/2006 |

(Continued)

OTHER PUBLICATIONS

Zhenyu Jiang, Lada Antonova Gyurova, Alois K. Schlarb, Klaus Friedrich, Zhong Zhang, Study on friction and wear behavior of polyphenylene sulfide composites reinforced by short carbon fibers and sub-micro TiO2 particles, Composites Science and Technology, vol. 68, Issues 3-4, Mar. 2008, pp. 734-742, ISSN 0266-3538, http://dx.doi.org/10.1016/j.*

(Continued)

*Primary Examiner* — Frantz Jules
*Assistant Examiner* — Steve Tanenbaum
(74) *Attorney, Agent, or Firm* — Haynes and Boone, LLP

(57) ABSTRACT

The invention is directed to an improved cryogenic cooler with an expander where the regenerator matrix is decoupled from the displacer or piston, thereby allowing the design of each to be optimized substantially independently. The regenerator matrix is preferably positioned spaced apart from the displacer and can be designed to enhance thermal exchanges and flow rates of the working gas. In one embodiment, the regenerator matrix has a serpentine shape or U-shape disposed around the displacer and the cold finger. Preferably, the regenerator matrix is static. The thermal lengths of the cold finger and/or the displacer can be extended by minimizing their geometrical lengths. Additionally, the structural integrity or stiffness of the cold finger and/or displacer can be strengthened.

18 Claims, 9 Drawing Sheets

(56) References Cited

U.S. PATENT DOCUMENTS

| | | | | |
|---|---|---|---|---|
| 4,475,346 | A | 10/1984 | Young et al. | |
| 4,505,119 | A | 3/1985 | Pundak | |
| 4,514,987 | A | 5/1985 | Pundak et al. | |
| 4,550,571 | A | 11/1985 | Bertsch | |
| 4,574,591 | A | 3/1986 | Bertsch | |
| 4,588,026 | A | 5/1986 | Hapgood | |
| 4,619,112 | A | 10/1986 | Colgate | |
| 4,711,650 | A | 12/1987 | Faria et al. | |
| 4,846,861 | A | 7/1989 | Berry et al. | |
| 4,858,442 | A | 8/1989 | Stetson | |
| 4,862,695 | A | 9/1989 | Kushnir | |
| 4,922,722 | A | 5/1990 | Kazumoto et al. | |
| 4,967,558 | A | 11/1990 | Emigh et al. | |
| 5,076,058 | A | 12/1991 | Emigh et al. | |
| 5,113,663 | A * | 5/1992 | Gifford | 62/6 |
| 5,197,295 | A | 3/1993 | Pundak | |
| 5,535,593 | A | 7/1996 | Wu et al. | |
| 5,596,875 | A | 1/1997 | Berry et al. | |
| 5,613,365 | A | 3/1997 | Mastrup et al. | |
| 5,647,219 | A * | 7/1997 | Rattray et al. | 62/6 |
| 5,680,768 | A * | 10/1997 | Rattray et al. | 62/6 |
| 5,822,994 | A | 10/1998 | Belk et al. | |
| 6,070,414 | A | 6/2000 | Ross et al. | |
| 6,156,970 | A * | 12/2000 | Harting et al. | 174/547 |
| 7,137,259 | B2 | 11/2006 | O'Baid et al. | |
| 7,296,418 | B2 | 11/2007 | Kirkconnell et al. | |
| 7,350,363 | B2 | 4/2008 | Stautner et al. | |
| 7,415,830 | B2 | 8/2008 | Wyatt et al. | |
| 7,555,908 | B2 | 7/2009 | Bin-Nun | |
| 7,587,896 | B2 | 9/2009 | Bin-Nun et al. | |
| 2004/0231340 | A1 * | 11/2004 | Bin-Nun et al. | 62/6 |
| 2006/0144054 | A1 | 7/2006 | Xu et al. | |
| 2006/0174635 | A1 | 8/2006 | Xu et al. | |
| 2007/0204610 | A1 | 9/2007 | Hatta | |
| 2007/0261416 | A1 | 11/2007 | Harvey et al. | |
| 2007/0261418 | A1 * | 11/2007 | Nun | 62/6 |
| 2007/0261419 | A1 * | 11/2007 | Bin-Nun et al. | 62/6 |
| 2009/0193966 | A1 * | 8/2009 | Phlegm et al. | 92/248 |

FOREIGN PATENT DOCUMENTS

| | | | |
|---|---|---|---|
| EP | 0803687 | | 10/1997 |
| JP | 4-236068 | A | 8/1992 |
| JP | 2000 292022 | A | 10/2000 |

OTHER PUBLICATIONS

Zhenyu Jiang, Lada Antonova Gyurova, Alois K. Schlarb, Klaus Friedrich, Zhong Zhang, Study on friction and wear behavior of polyphenylene sulfide composites reinforced by short carbon fibers and sub-micro TiO2 particles, Composites Science and Technology, vol. 68, Issues 3-4, Mar. 2008, pp. 734-742, ISSN 0266-3538, http://dx.doi.org/10.1016/.*

* cited by examiner

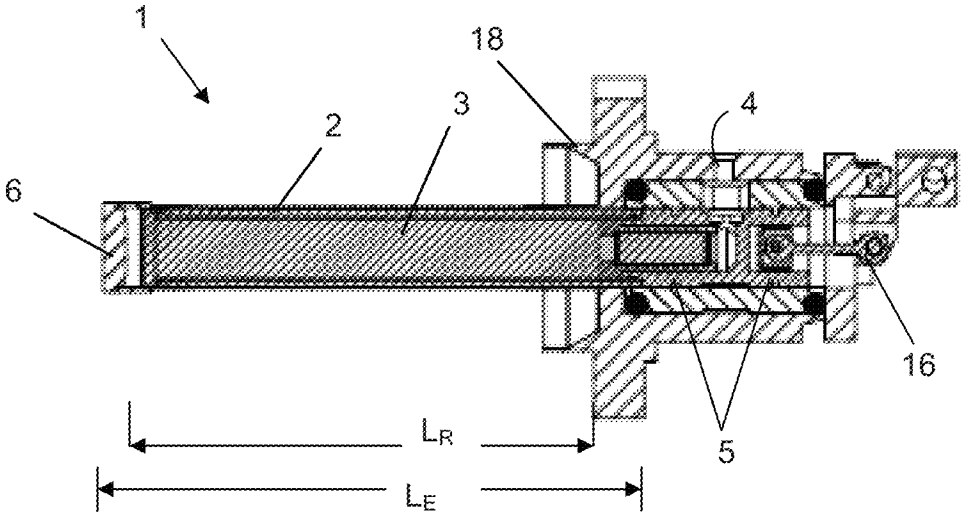
FIGURE 1 (Conventional)

EXPANDER FOR STIRLING ENGINES AND CRYOGENIC COOLERS

FIELD OF THE INVENTION

This invention generally relates to improved miniaturized Stirling engines having efficient regenerator, displacer and cold finger designs suitable for used in cryogenic coolers.

BACKGROUND OF THE INVENTION

Conventional Stirling Cycle Rotary Cooling Engines generally have a compressor and an expander connected to a crank mechanism driven by an electrical motor. The compressor, also known as a pressure wave generator. It is attached to the warm end of the expander and delivers acoustic power (compressor PV work) into the expander warm end inlet. Compressor PV work is the integration of the pressure-volume curve over one thermodynamic cycle or one complete revolution of the crank shaft. Compressor PV work has a unit of energy, and when derived over time, it is defined as acoustic power. The expander recovers this work at the cold end by causing the gas to expand and thus absorb heat from external power source such as an IR sensor. The gas expansion is achieved mechanically by placing the expander piston and compression piston at 90 deg mechanical phase to each other relative to the crank shaft. A working fluid, typically a noble gas, is compressed at the warm end and is expanded at the cold end. At the distal tip of the expander coldwell, when the expander piston is being pulled backward to iso-thermally expand the working gas, heat is absorbed from the load and very low temperatures are achieved due to efficient thermal isolation between the warm and cold end of the expander unit. Temperature can reach down to the cryogenic range, e.g., about 77° K. An infrared (IR) sensor, which needs to operate at such low temperatures, is attached to the coldwell to be cooled. A conventional Stirling engine is described in U.S. Pat. Nos. 7,555,908 and 7,587,896 and references cited therein, which are incorporated herein by reference in their entireties. Stirling engines are commonly used as cryogenic coolers to cool IR sensors for IR cameras and the like.

A conventional expander 1, illustrated in FIG. 1, generally consists of cold finger 2, which is a small diameter, thin-wall cylinder/tube, and a displacer unit 3 positioned in the cold finger. Displacer unit 3 comprises a canister tightly packed with metallic fine mesh, spheres or felt-like material, and moves within cold finger 2. The metallic fine mesh, spheres or felt-like material is also known as the regenerator matrix and is designed to exchange thermal energy with the working fluid. Displacer unit 3 is slip fit into cold finger 2 to provide precise linear reciprocating motion between the cold finger and the displacer. Working gas from the warm end enters expander 1 at the proximal end of displacer unit 3 at inlet 4. Since displacer unit 3 undergoes reciprocating motion, inlet 4 is static while inline with a moving slotted inlet machined into the displacer at the warm end clearance dynamic seal 5 and thus allows free flow into the regenerator regardless of its position. Reciprocating dynamic seals 5 prevent leakage of the working gas as it enters the moving displacer unit. Also, it prevents the cold gas present in the clearance between the displacer and the expander cylinder from escaping into to warm end during the expansion portion of the cycle. The working gas then enters the regenerator matrix to exchange thermal energy with the regenerator, and is pre-cooled. The working gas reaches the distal end of the displacer unit proximate to coldwell 6 ideally at the same temperature it left at the previous cycle right after the expansion. For an infrared-based system, an IR sensor is attached to coldwell 6 to be cooled.

The reciprocating motion of displacer unit/canister 3, more specifically the movement away from coldwell 6, isothermally expands the working gas causing it to cool down and absorb heat from the thermal load. Subsequently the expander piston/displacer moves toward the end cap and forces the working gas to flow back toward the warm end through the regenerator matrix to exchange thermal energy therewith, and is warmed. Hence, displacer unit 3 functions both as a displacer and regenerator. Displacer unit 3 also functions as piston and thus performs the expansion process in the thermodynamic cycle. The design of such an expander in which the displacer unit performs three different functions, i.e., displacer, regenerator and expansion piston, requires the system engineer to perform trade offs among various system requirements which can be often conflicting.

For example, the need to provide thermal barrier/insulation between the warm end and the cold end favors the cold finger 2 be long, thin and have a small diameter, since heat conduction along tube 2 would be minimized. On the other hand, the demand for miniaturization and rigidity of expander 1 favors the opposite. One major challenge when attempting to reduce expander length is the need to maintain a predetermined surface area for a given mass flow rate and cooling capacity by the regenerator matrix.

A regenerator used in a Stirling engine can be thought of as a one-way and a bidirectional heat exchanger in which thermal energy flows in and out of the matrix and to or from the working gas. The heat exchanging media, i.e., the regenerator matrix, is usually made of light felt-like mass of fine wire stacked in an insulated tube as shown in FIG. 1. The fine wire mesh is commonly obtained in a form of woven screen in a variety of wire sizes, weave structures, mesh density and materials. Other known types of regenerator matrices use spheres made of stainless steel, bronze, lead and erbium, among others. Common Stirling engine regenerator matrices usually have large thermal capacity, large surface area, low flow impedance, small void volume and large axial thermal resistance to achieve high regenerator effectiveness. Cooler performance is sensitive to regenerator effectiveness. A regenerator is considered to be "100% effective" when the temperature of the working fluid exiting the regenerator is equal to the temperature of working fluid entering it. When the temperature of the gas leaving the regenerator at the compressor end is colder than the entering gas, it indicates that not enough thermal energy was exchanged with the regenerator matrix. This causes the regenerator to be warmer than it could have been, thus reducing the pre-cooling of the incoming gas prior to it entering the expansion space. It is a challenge to minimize the length of the expander while maintaining efficient thermal exchange, i.e., adequate regenerator surface area, minimum pressure drop, large axial thermal resistance along the regenerator, large thermal capacitance and minimum weight.

The conventional expander assembly overall length $L_E$ shown in FIG. 1, is determined primarily by the regenerator length $L_R$, while regenerator length $L_R$ is determined by expander 1's need for large matrix surface area, regenerator tube thermal resistance, regenerator matrix thermal contact resistance and shuttle losses consideration. Satisfying these design constraints has resulted in a relatively long expander assembly length $L_E$ and thus limits the ability to miniaturize the overall cryogenic cooler.

Hence, there remains a need for an improved cryogenic cooler that is further miniaturized and more specifically for a shorter, more compact expander.

SUMMARY OF THE INVENTION

Hence, the invention is directed to an improved cryogenic cooler with an expander where the regenerator matrix is decoupled from the displacer or piston, thereby allowing the design of each to be optimized substantially independently. The regenerator matrix is preferably positioned spaced apart from the displacer and can be designed to enhance thermal exchanges and flow rates of the working gas, and to preferably maintain proper phase relationship between the mass flow rate and pressure inside the regenerator independent of displacer/expander piston length and diameter. In one embodiment, the regenerator matrix has a serpentine shape or U-shape disposed around the cold finger and displacer/expander unit. Preferably, the regenerator matrix in this embodiment is static.

Unlike the common displacer which acts as an expander piston and regenerator, the inventive displacer serves only one purpose and it is to perform gas expansion operation and gas displacement. It does not have to contain within it the regenerator and thus its geometry and mechanical structure can take any shape and be optimized for maximum thermal insulation and mechanical flexibility/self alignment with cylinder bore with lower thermal conduction to minimize heat conduction loss along the displacer. In one embodiment, the displacer can be a stiff hollow cylinder with a closed end proximate to the coldwell and made from a low thermal conductive, engineered plastic. In another embodiment, the displacer can have a piston head proximate to the coldwell and a thin shaft or rod, which has a small diameter to minimize heat conduction loss. The thin shaft may have a flexural modulus that allows the displacer to self-correct to minimize frictional contacts with the cold finger which can generate heat.

The invention is also directed to a cold finger that has a thermal effective length that is substantially longer than its physical or geometrical length. In one embodiment, the cold finger comprises a plurality of tubes that are arranged in a concentric arrangement and are connected selectively to form a serpentine thermal path to reduce heat conduction loss. Stiffeners can be used with the plurality of tubes to enhance the structural integrity or stiffness of the cold finger.

BRIEF DESCRIPTION OF THE DRAWINGS

In the accompanying drawings, which form a part of the specification and are to be read in conjunction therewith and in which like reference numerals are used to indicate like parts in the various views:

FIG. 1 is a cross-sectional view of a conventional Stirling engine expander unit;

DETAILED DESCRIPTION OF THE PREFERRED EMBODIMENTS

Figure 2A:
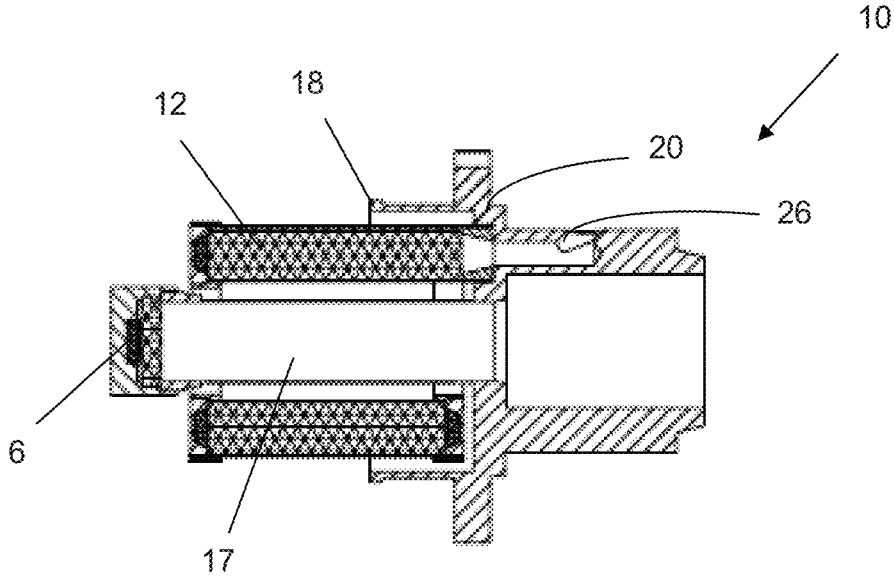
FIG. 2A is a cross-sectional view of an expander, with a displacer omitted for clarity, according to one embodiment of the invention.
Figure 2B:
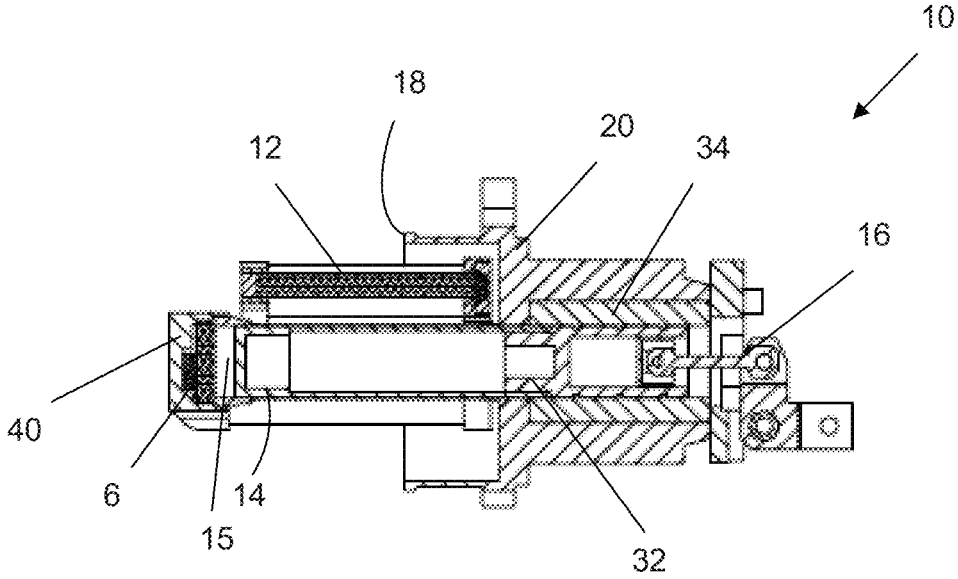
FIG. 2B is a cross-sectional view of the embodiment shown in FIG. 2A with the regeneration matrix decoupled from the displacer unit.
Figure 3:
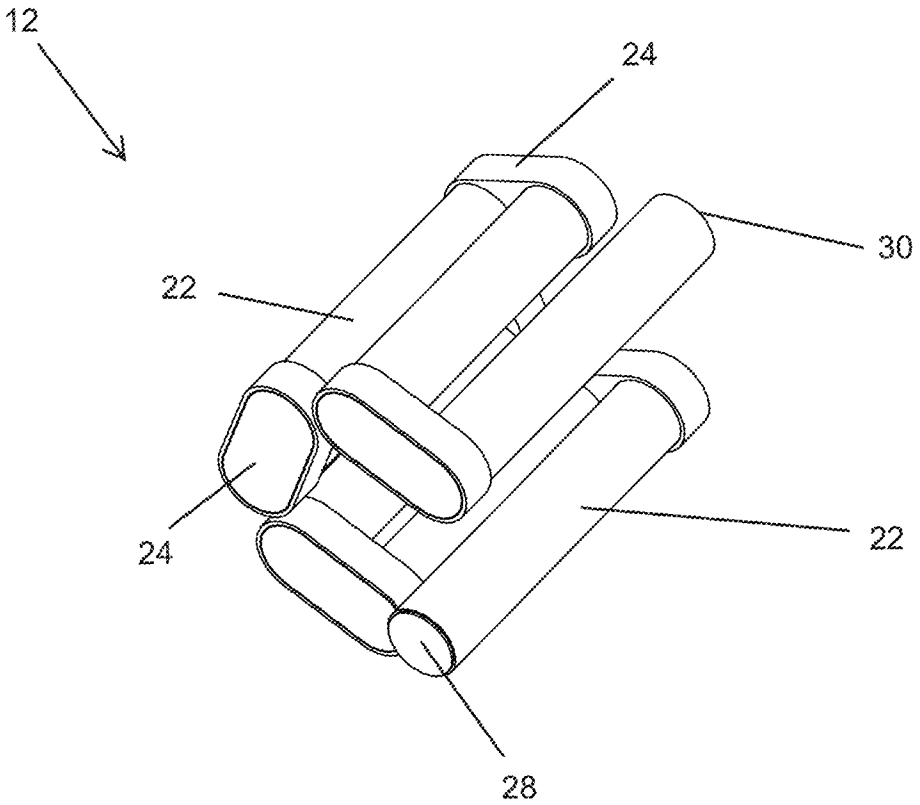
FIG. 3 is a perspective view of the regenerator matrix shown in FIGS. 2A and 2B.

Embodiments of the invention are directed to an expander unit 10, which is usable in a Stirling engine or in a cryogenic cooler for an IR camera. As illustrated in FIGS. 2A, 2B and 3, regenerator matrix 12 is decoupled from displacer unit 14. Inventive regenerator matrix 12 is static, i.e., it does not move when displacer unit 14 undergoes reciprocating motion to displace the working gas in the Stirling thermodynamic cycle. Displacer unit 14 is connected (not shown) to displacer drive linkage 16, which is connected to the Stirling engine's driving motor. Reciprocal motions by displacer 14 expand the working gas in expansion space 15.

In this embodiment, regenerator matrix or regenerator 12 is placed outside the displacer 14 and inside a vacuumed Dewar enclosure (not shown), which includes Dewar adapter ring 18. In this embodiment, displacer unit 14 is a cylinder with a closed distal end that forms part of expansion space 15. Displacer unit 14 is slidingly received in a cylindrical cold finger 17, which is supported by cold-finger base 20. Cold finger 17 extends from base 18 toward end cap heat exchanger 40. The clearance between displacer unit 14 and cold finger 17 is preferably small to minimize or prevent the escape of working gas from expansion space 15. Generally, this clearance is in the range of 0.0005 inch. However, this clearance is preferably sufficient to minimize the heat caused by the frictional contact between cold finger 17 and displacer 14.

As best shown in FIG. 3, regenerator matrix 12 is an assembly comprising multiple tubes 22, which are connected to each other at their ends by connectors 24 to form U-shape interconnections or a serpentine path. In this embodiment, regenerator matrix 12 is preferably arranged around and external to displacer 14 and cold finger 17 in a circular pattern. This arrangement allows for a linearly short and compact regenerator matrix with relatively long effective thermal length.

Referring to FIGS. 2A, 2B and 3, warm working gas, preferably at a room temperature of about 296° K, enters and exits expander 10 at port 26 and enters proximal opening 28 of regenerator 12. The warm working gas exchanges thermal energy with, and is cooled by, regenerator 12 along the U-shape path formed by tubes 22 and connectors 24. The working gas then exits regenerator 12 at distal opening 30 at the cryogenic temperature, e.g., about 77° K, if the thermal efficiency of the regenerator is 100%. The working gas then enters expansion space 15. Displacer 14 then moves away from end cap heat exchanger 40 to expand, and thus cool, the working gas. An IR sensor, or other object to be cooled, attached to end cap heat exchanger 40 is chilled by this thermodynamic cycle. No working gas travels through displacer 14. In this embodiment, the cooled gas flows back through the heat exchanger in the end cap 40 into the regenerator tubes toward the compressor. In the conventional design, the gas is cooled and pulled away from the end cap toward the displacer which houses the regenerator matrix. The inventor of the present invention discovered through tests and experiments that this inventive design provides faster cool down than the conventional design. The cold gas flows at high speed through end cap heat exchanger 40 which does not exist in the common design thereby providing improved heat lift or heat transfer from the end cap on which power is dissipated by the detector. Given the same cooling capacity, the inventive expander design will provide about 25% faster cool down than the conventional expanders.

As displacer 14 moves toward end cap heat exchanger 40, the working gas is forced to flow back into distal opening 30 toward proximal opening 28, where it exchanges thermal energy with regenerator 12 and is warmed. When the thermal efficiency of regenerator 12 or expander 10 is 100%, the working gas exits proximal opening 28 at room temperature and back toward the compressor portion of the Stirling engine through port 26. Preferably, the thermal length of regenerator 12 is sufficient to achieve 100% thermal effectiveness.

The reciprocal movement of displacer 14 is provided by its connection through drive linkage 16 and is supported by displacer guideway journal 32 and displacer guideway sleeve 34. Sleeve 34 in which the displacer warm end clearance seal journal 32 is guided at very close clearance fit in the order of micro inches. This tight fit provide a seal that prevents warm gas from escaping into the expander and also prevent cold gas in the expander from being pumped out in to the warm end Displacer guideway journal 32 therefore provides a clearance seal for displacer 14 and also functions as a thermal barrier and a flow restrictor keeping the working gas within its intended path.

End cap 40 is provided above cold finger 17 to provide a path for the working gas from distal opening 30 at the end of regenerator 12 to expansion space 15, and vice versa. End cap 40 also serves as a housing for a cold heat exchanger mesh. This heat exchanger mesh is made of high conductivity material to facilitate heat flow from the external heat load, such as the detector or IR sensor, into the cold working gas. This increases efficiency of the expander and the cryogenic cooler, provides faster cool down time, and represents improvements over conventional expanders.

Preferably, displacer 14 is constructed from a strong, lightweight material to minimize the vibration caused by sinusoidal motion at high speed. Displacer 14 should also have a low coefficient of conduction heat transfer to minimize the heat transfer by conduction in the longitudinal direction from the warm end or Dewar ring 18 to end cap heat exchanger 40 to minimize heat conduction loss. Suitable materials include polyphenylene sulfide (PPS) or PPS reinforced with fibers or fiberglass fibers, commercially available as Ryton® from Quadrant Extreme Materials.

Unlike the conventional Stirling engine shown in FIG. 1, where the regenerator matrix is inside displacer unit 3 and moves with displacer 3, regenerator 12 as shown in FIG. 2A is static relative to expander 10 and inlet port 26 is static. A dynamic inlet, such as moving gas inlet 4, is not necessary, and the design of the working gas inlet can be simplified, resulting in reduced PV power losses due to improved inlet seal, since there is generally a certain amount of leakage present with dynamic seals. Further, the lack of a need to move the regenerator matrix during the thermodynamic cycle reduces vibration and noise due to lower moving mass.

The novel regenerator design of this embodiment is significantly shorter linearly than conventional regenerator matrix 3 shown in FIG. 1, and yet has a longer effective thermal length, which includes the thermal paths along the U-shape or serpentine path comprising tubes 22 and connectors 24. This embodiment provides a longer thermal path, a higher thermal resistance, and a large regenerator matrix surface area, which lead to effective regenerator and efficient thermodynamic cycle. Additionally, the use of low thermal conductivity materials and thin wall tubes for displacer unit 14 and cold finger 17 increases the thermal resistance and thus reduces heat leak toward expander 10's end cap heat exchanger 40.

An advantage of regenerator 12 is the additional cooling capacity resulting from lower thermal losses, which enables a reduction of the compressor size as well as the overall linear length of expander 10. The relatively long effective thermal length of the combined tubes 22 of regenerator 12 allows for the use of coarser metal mesh or spheres to reduce pressure drop and maintaining adequate surface area for the regeneration process of the thermodynamic cycle. Unlike the conventional approach, this embodiment optimizes regenerator design substantially independently of the design and requirements of displacer 14 and cold finger 17, such as the total volume necessary to hold the regenerator material and the structural integrity of the cold finger which supports highly sensitive optical electronics sensors, e.g., IR detectors. For example, the need to trade off regenerator length (thermal resistance and surface area) with the expander length (cold finger structural stiffness) is no longer necessary, since the length of the displacer 14 is independent of the length of regenerator 12, and these elements can be optimized separately.

In conventional expanders 1, both the regenerator 3 and displacer 2 are supported by the cold-finger and their reciprocal movements cause a low natural bending frequency. These frequencies often cause end cap heat exchanger 40, which supports the IR sensors, to vibrate, further leading the IR sensors to experience significant movements and a decrease the quality of the thermal images. By decoupling regenerator 12 from displacer unit 14, the regenerator, generally the heaviest component of expander 10, is kept static. Keeping the regenerator 12 static as described above provides an advantage by obviating this self-induced vibration and the low natural bending frequency.

Another advantage is that with the regenerator 12 decoupled from the displacer unit, additional room or space is available to strengthen displacer 14, e.g., by stiffening the displacer and reducing unwanted movements or vibrations.

Figure 4:
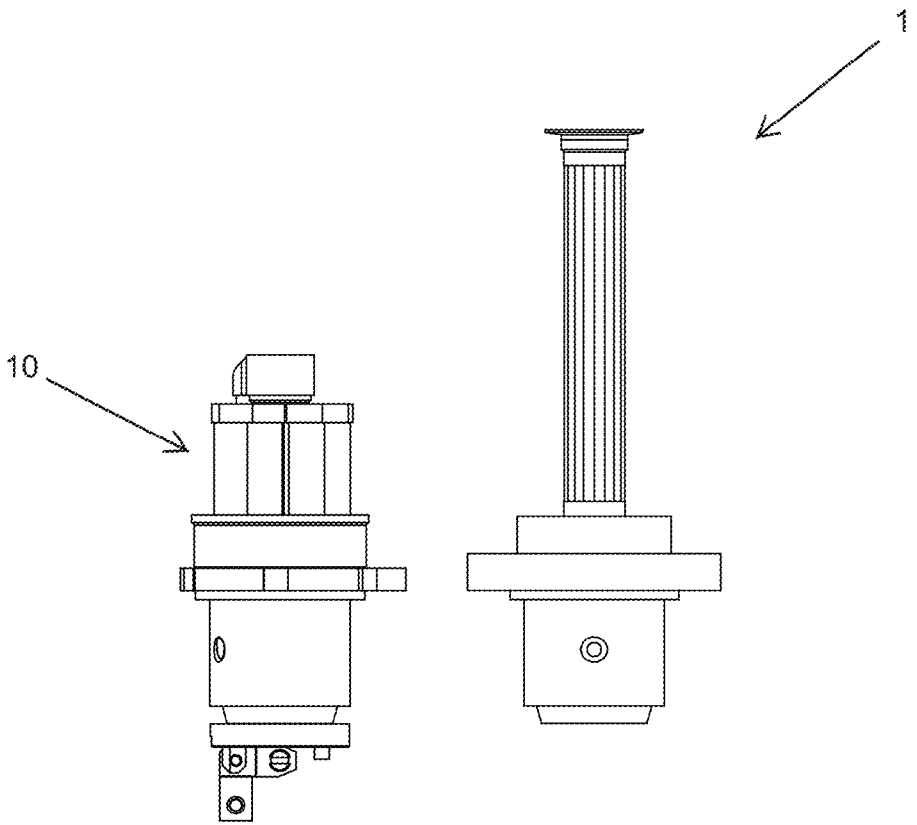
FIG. 4 is a side-by-side perspective view of an expander according to one embodiment of the invention and a conventional expander.
Figure 5:
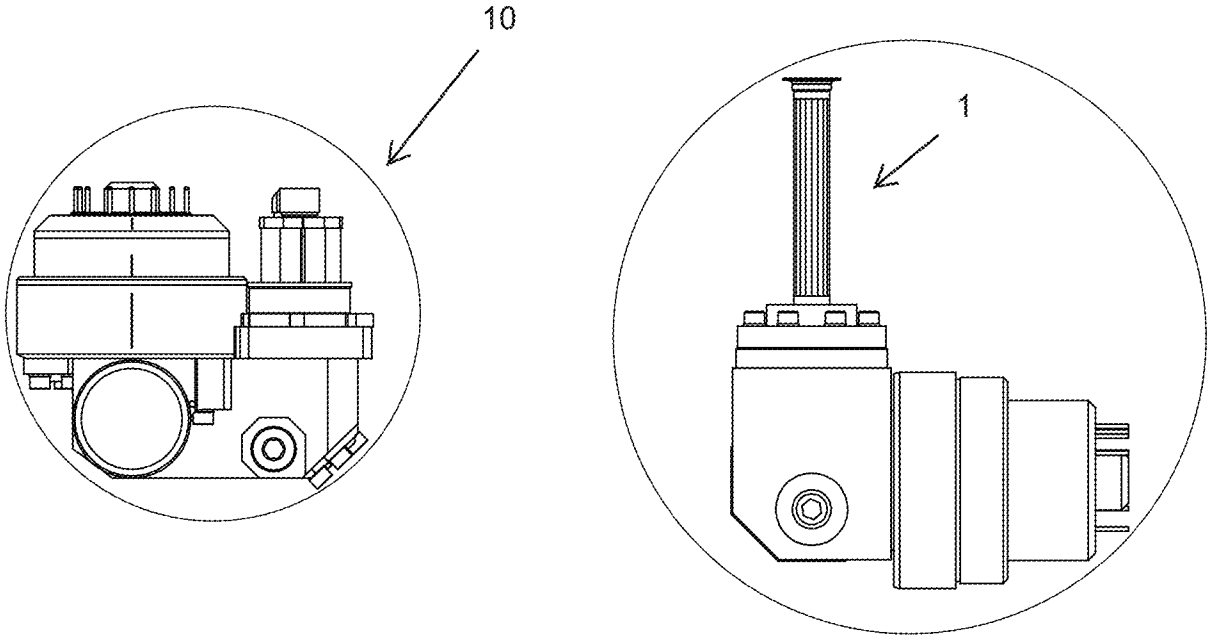
FIG. 5 is a side-by-side perspective view of a cryogenic cooler according to one embodiment of the invention and a conventional cryogenic cooler.

Employing regenerator 12 in place of conventional regenerator 1 results in a significant reduction in the length of the expander. As illustrated in FIG. 4, expander 10 shown on the left is about 47% shorter than conventional expander 1 shown on the right. In this example, the length of expander 10 is about 1.00 inch from the Dewar ring to its tip, as compared to the 1.89 inch length of conventional expander 1. Furthermore, as illustrated in FIG. 5 a conventional cryogenic cooler shown on the right using conventional expander 1 would fit in a circular envelope having a radius of about 4.125 inch, while an embodiment of a cryogenic cooler shown on the left using expander 10 can fit into an envelope with a diameter of about 2.62 inch. The reduced volume is about one-fourth of the volume of the conventional cryogenic cooler, since the reduction in volume is the cube of the radius and the reduction in surface area is the square of the radius.

In an alternative embodiment, regenerator 12 comprises a single thick-wall hollow cylindrical member that is positioned around cold finger 17 and displacer 14. Within the thick-wall cylindrical member, a serpentine path comprising metal mesh or spheres similar to those discussed above with proximal and distal openings 28 and 30 is provided to exchange thermal energy with the working gas. A single piece regenerator may simplify the manufacturing process. Embodiments of the invention are not limited to any particular shape of the regenerator.

Figure 6B:
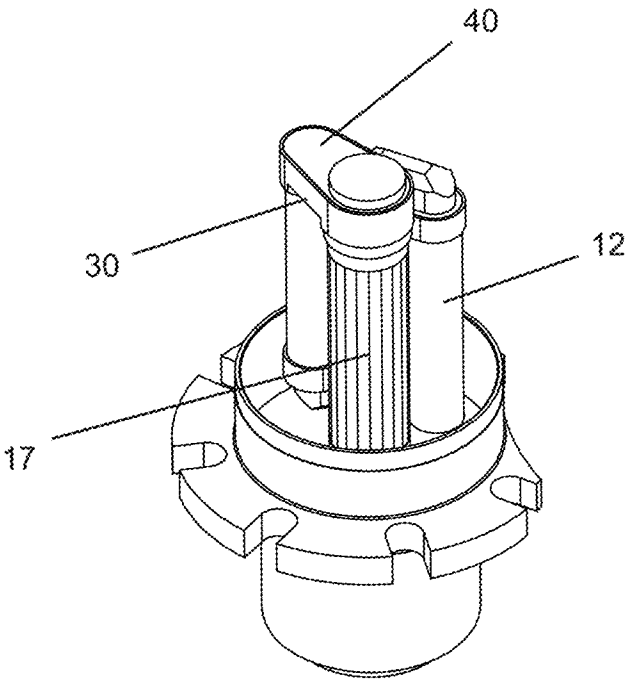
FIG. 6B is a perspective view of the expander of FIG. 6A.
Figure 6A:
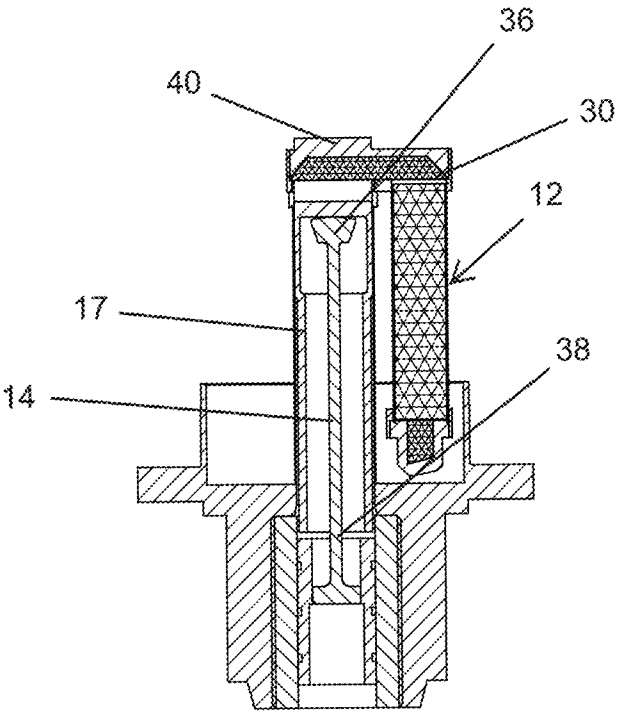
FIG. 6A is a cross-sectional view of an expander showing an alternative displacer according to one embodiment of the invention.

In another alternative embodiment, displacer 14 comprises piston head 36 and shaft 38, as shown in FIG. 6A. Piston head 36 forms a part of expansion space 15 and shaft 38 preferably has a diameter smaller than the diameter of piston head 36 in order to minimize heat conduction and heat loss to the cold-well. Additionally, shaft 38 is flexible so that it can self-correct any misalignment between piston head 36 and cold finger 17. Misalignments cause frictional contacts or rubbing, which produces heat and lowers the efficiency of the expander. Preferably, the flexural modulus of shaft 38 is about one order of magnitude of the flexural modulus of the regenerator matrix, resulting in improved about an order of magnitude less frictional contact than conventional displacer/canister 3. Also, since shaft 38 is flexible, expander 10 may operate with smaller operational clearance with better seal.

Figure 7B:
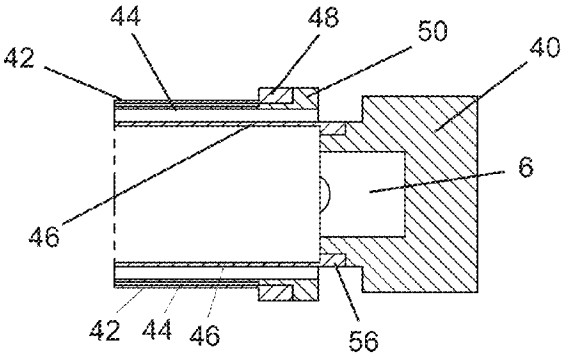
FIG. 7B is an enlarged view of the coldwell portion of FIG. 7A.
Figure 7A:
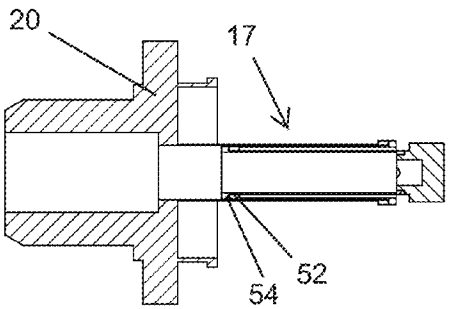
FIG. 7A is a cross-sectional view of an expander showing a cold finger, with parts omitted for clarity, according to one embodiment of the invention.

In another embodiment to reduce heat conduction loss along the cold finger, cold finger 17 is constructed from a plurality of concentric tubes that are attached to each other in a heads-and-tails fashion, as shown in FIGS. 7A and 7B. Cold finger 17 provides structural support for the IR detector, thermal barrier between the warm end and the cold end, and expansion volume. Cold finger 17 also forms a cylinder/guide way for displacer 14, as it reciprocates. In this embodiment, cold finger 17 has enhanced structural integrity to support the IR detector and enhanced thermal conduction resistance, while minimizing its length to support miniaturization.

As shown, cold finger 17 is made of three tubes 42, 44, 46 which are successively smaller and are welded "heads and tails" inside each other in a concentric geometry. However, cold finger 17 is not limited to any particular number of tubes. The first and largest diameter outer tube 42 is the primary tube and is an integral part of the cold finger base 20 for structural integrity. Alternatively, primary outer tube 42 can be threadedly connected to cold finger base 20. Middle tube 44 is inserted into the primary outer tube and welded, preferably laser welded, at the top, as best shown in FIG. 7B. Preferably primary outer tube 42 has enlarged head 48 and middle tube 44 has enlarged head 50 to provide a relatively larger surface for the weld. At the opposite end tubes 42 and 44 are kept free from contact with each other. Inner tube 46 is welded to middle tube 44 at the bottom and extends out into the Dewar vacuum space and is attached, welded and sealed to end cap 40, thus forming expansion space 15. Preferably, middle tube 44 has an enlarged head 52 which is welded to an enlarged head 54 of inner tube 46, and inner tube 46 has an enlarged head 56 to be attached to cap 40.

Figure 7C:
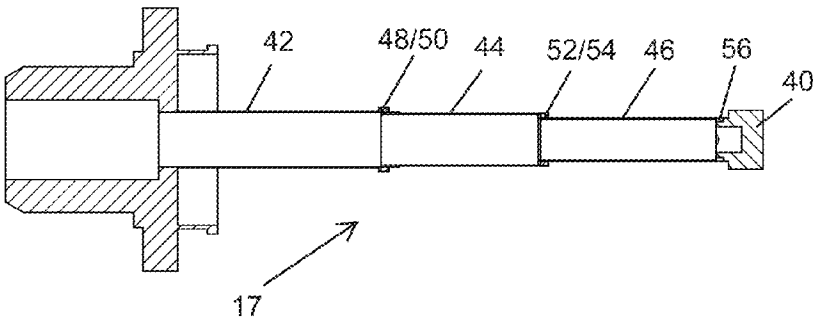
FIG. 7C shows the effective thermal length of the cold finger shown in FIGS. 7A and 7B.

Since the spacing between tubes 42, 44 and 46 is a vacuum the primary heat transfer mechanism is heat conduction, which is limited to the path along primary tube 42, weld joint 48/50, middle tube 44, weld joint 52/54, inner tube 46 and joint 56/end cap 40. If fully extended, this thermal conduction path shown in FIG. 7C is significantly longer than the physical or geometrical length shown FIG. 7A. This reduction in heat conduction loss translates into an increase in cooling capacity, which can be traded for a smaller size compressor and motor for the Stirling engine and cryogenic cooler.

Figure 8B:
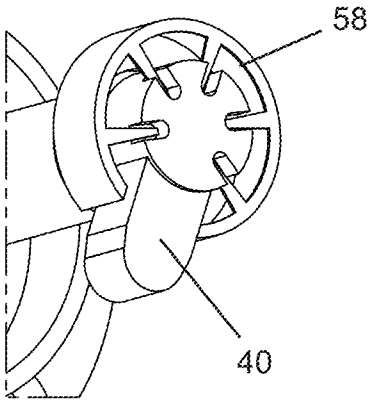
FIG. 8B is an enlarged perspective view of the stiffener.
Figure 8A:
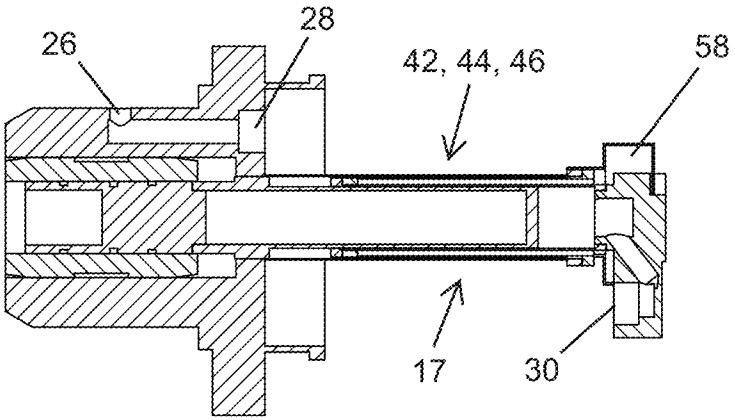
FIG. 8A is a cross-sectional view of the expander of FIGS. 7A-7B with a stiffener.

Since three or more tubes are used to construct cold finger 17, in an alternative embodiment, tubes 42, 44, 46 may have insulated spacers or stiffeners between them to minimize vibrations which may cause movements of the IR detector attached to end cap heat exchanger 40. These spacers may be discrete or may cover a circumference of one or more tubes. Alternatively, a thin wall flexure stiffener 58 is attached preferably by welding to primary outer tube 42, which is attached directly to cold finger base 20 to provide optionally additional support, as shown in FIGS. 8A and 8B. Preferably, stiffener 58 is made from titanium or other metals. Stiffener 58 is preferably thin to lower its thermal capacity and heat transferability and is spot welded at few spots to minimize heat leak.

Figure 9B:
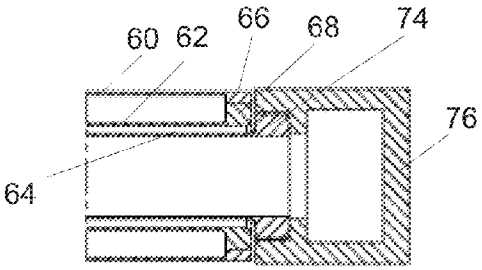
FIG. 9B is an enlarged view of the distal end of the displacer of FIG. 9A.
Figure 9C:
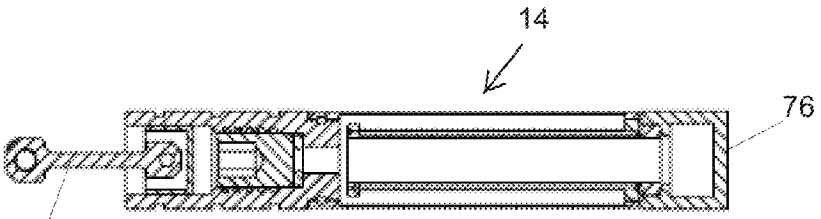
FIG. 9C is a cross-sectional view of the displacer of FIG. 9A with end cap and drive linkage.
Figure 9D:
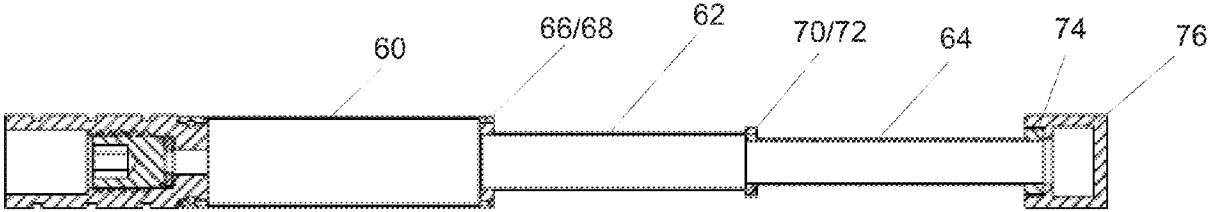
FIG. 9D shows the effective thermal length of the displacer shown in FIGS. 9A-9C.
Figure 9A:
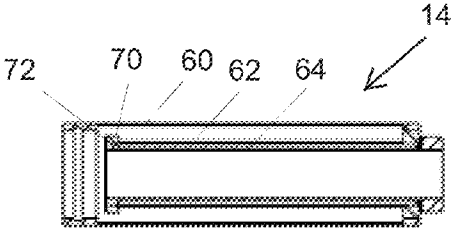
FIG. 9A is a cross-sectional view of a multi-tube displacer.

The multi concentric tube structure of cold finger 17 can also be applied to the design of displacer 14, as shown in FIGS. 9A-9D. In this embodiment, displacer 14 comprises outer tube 60, middle tube 62 and inner tube 64. Similar to the construction of multi-tube cold finger 17, outer tube 60 has enlarged head 66 which is welded to enlarged head 68 of middle tube 62 at the distal end of displacer 14. Middle tube 62 is connected preferably by welding at the proximal end via its enlarged head 70 and enlarged head 72 of inner tube 64. Inner tube 64 is connected at enlarged head 74 to end 76. End 76 is the distal end of displacer 14, which as discussed above forms a part of the expansion space. As best shown in FIG. 9D, the conductive thermal length of displacer 14 is significantly longer than its geometrical length best shown in FIG. 9C.

The improved thermal efficiencies described above to minimize heat losses in accordance with embodiments of the present invention can be described as follows. Heat loss caused by the reciprocating motion of the displacer/piston is Q and is governed by the following equation:

$$Q_s = 186 \times S^2 \times \pi \times d \times K_g \times \frac{T_h - T_c}{T_g \times L}$$

where:

S displacer/piston stroke
d displacer/piston diameter
Kg average thermal conductivity
$T_h$ hot end temperature
$T_c$ cold end temperature
$T_g$ clearance piston/cold finger
L displacer/piston length Hence, shuttle losses in Stirling cryogenic coolers can be reduced by increasing clearance $T_g$ and reducing piston diameter d. Both are accomplished when regenerator matrix 12 is spaced apart and not carried in displacer 14, as described above. Specifically, as shown in FIG. 6A displacer 14 comprises rod 38 and piston head 36, where rod 38 has a small diameter compared to conventional expander 1 when displacer 3 carries the regenerator matrix therewithin. Furthermore, the clearance between cold finger 17 and piston head 36 is relatively larger.

Heat loss through conduction $Q_c$ from the warm end proximate to the entrance of warm working gas to end cap heat exchanger 40 is controlled by the heat conduction equation, $$Q_c = \pi \cdot d^2 \cdot 0.25 \cdot K/L,$$

where:

L displacer/piston length

K thermal conductivity d displacer/piston diameter $Q_c$ is minimized both along displacer 14 and cold finger 17. In the embodiment shown in FIG. 2B, the displacer is hollow to reduce its effective diameter and is made from PPS which has a low K value. In the embodiment shown in FIG. 6A, the displacer comprises a thin shaft to reduce its diameter. In the embodiment of FIGS. 7A and 7B, the effective thermal length L of cold finger 17 is extended with using multiple concentric tubes connected in a heads-and-tails fashion.

Another avenue of heat loss is caused by pressure waves generated inside the expansion space 15 due to the reciprocating motion of displacer 14 and resulting volume change of expansion space 15. The pressure wave forces cold gas to back flow through the piston/cylinder clearance and is considered a thermodynamic loss. The same process repeats when the pressure drops and hot gas flows into the cold space from the warm end through the same gap. Since displacer 14 contains no regeneration matrix and cold finger 17 is made from a thin wall tube with a long effective thermal length, the clearance between the cold finger and the displacer can be reduced with very little friction, thus more effectively sealing the expansion space from the surrounding. Also, in the embodiment shown in FIG. 6A where the piston shaft 38 is made from a thin titanium rod with higher flexibility, the clearance can be reduced at the cold end leading to lower losses due to back flow from expansion space 15.

This heat loss through the pumping action, Q, is illustrated by the following equation.

$$Q = \frac{\Delta P \times h^3 \times S}{\mu \times 12 \times t}$$

where:

Q Flow rate (i.e., heat leak through clearance cold finger 17/displacer 14)

ΔP Pressure drop h Clearance piston cold finger/displacer t Piston length

μ Gas viscosity

S Piston cold end circumference

The flow/leak is most sensitive to the clearance h since it is to the power of 3 and thus leak can be reduced and thermodynamic losses as well. As discussed in the preceding paragraph, the embodiment of FIG. 6A reduces this heat loss due to pumping action.

While it is apparent that the illustrative embodiments of the invention disclosed herein fulfill the objectives stated above, it is appreciated that numerous modifications and other embodiments may be devised by those skilled in the art. Feature(s) from one embodiment can be used interchangeably with other embodiment(s). Therefore, it will be understood that the appended claims are intended to cover all such modifications and embodiments, which would come within the spirit and scope of the present invention.

What is claimed is:

1. An expander for a cooler comprising:

an outer cylinder;

a displacer disposed in the outer cylinder and adapted for reciprocal motion relative to the outer cylinder;

an expansion space adapted to expand a working fluid, wherein the expansion space is defined at a distal end of the expander between the outer cylinder and the displacer;

a regenerator matrix disposed spaced apart from the displacer and static relative to the outer cylinder, wherein the regenerator matrix comprises a serpentine shape or a plurality of U-shape paths and a thermal effective length longer than a length of the outer cylinder along a direction of the reciprocal motion of the displacer;

an end cap located at the distal end of the outer cylinder to conduct the working fluid from the regenerator matrix to the expansion space; and an infrared sensor of an infrared camera thermally coupled to the end cap, wherein the cooler cools the infrared sensor of the infrared camera.

2. The expander of claim 1, wherein the regenerator matrix has a 100% thermal effectiveness.

3. The expander of claim 1, wherein the regenerator matrix is disposed around the outer cylinder in a circular pattern.

4. The expander of claim 1, wherein the length of the outer cylinder along the direction of the reciprocal motion of the displacer is less than approximately 1.89 inches.

5. The expander of claim 1, wherein the displacer comprises a piston head and a shaft, wherein a diameter of the shaft is smaller than a diameter of the piston head.

6. The expander of claim 1, wherein the end cap further comprises a heat exchanger mesh to facilitate heat flow from an external heat load thermally coupled to the end cap into the working fluid in the expansion space.

7. The expander of claim 1, wherein the displacer comprises polyphenylene sulfide.

8. The expander of claim 7, wherein the polyphenylene sulfide is reinforced.

9. The expander of claim 1, wherein the outer cylinder comprises a plurality of concentric tubes selectively connected to form a heat conduction flow path longer than the outer cylinder's length along a direction of the reciprocal motion of the displacer.

10. The expander of claim 1, wherein the concentric tubes are connected in a heads-and-tails fashion.

11. The expander of claim 9, wherein the outer cylinder further comprises a stiffener supporting at least one of the tubes.

12. The expander of claim 11, wherein the stiffener is positioned at the distal end of the expander.

13. The expander of claim 12, wherein the stiffener comprises one or more spacers positioned between the concentric tubes.

14. The expander of claim 1, wherein the outer cylinder is a cold finger.

15. An expander for a cooler comprising:

an outer cylinder;

a displacer disposed in the outer cylinder and adapted for reciprocal motion relative to the outer cylinder;

an expansion space adapted to expand a working fluid, wherein the expansion space is defined at a distal end of the expander between the outer cylinder and the displacer, and wherein the outer cylinder or the displacer comprises a plurality of concentric tubes selectively connected to form a heat conduction flow path longer than the outer cylinder's length along a direction of the reciprocal motion of the displacer;

a regenerator matrix disposed spaced apart from the displacer and static relative to the outer cylinder, wherein the regenerator matrix comprises a serpentine shape or a plurality of U-shape paths and a thermal effective length longer than a length of the outer cylinder along a direction of the reciprocal motion of the displacer;

an end cap located at the distal end of the outer cylinder to conduct the working fluid from the regenerator matrix to the expansion space; and an infrared sensor of an infrared camera thermally coupled to the end cap, wherein the cooler cools the infrared sensor of the infrared camera.

16. The expander of claim 15, wherein the concentric tubes are connected in a heads-and-tails fashion.

17. The expander of claim 16, wherein the outer cylinder further comprises a stiffener supporting at least one of the tubes.

18. A method for using the expander of claim 1, the method comprising;

reciprocating the displacer within the outer cylinder to conduct working fluid to and from the expansion space through the regenerator matrix; and cooling the end cap to absorb heat from the infrared sensor.

* * * * *

UNITED STATES PATENT AND TRADEMARK OFFICE

CERTIFICATE OF CORRECTION

PATENT NO. : 8,910,486 B2
APPLICATION NO. : 12/841280
DATED : December 16, 2014
INVENTOR(S) : Uri Bin-Nun et al.

It is certified that error appears in the above-identified patent and that said Letters Patent is hereby corrected as shown below:

On the title page, (75) Inventors:

Change 3rd Inventor "Xiaoyuan Lei" to -- Xiaoyan Lei --

Signed and Sealed this
Twenty-first Day of April, 2015

Michelle K. Lee

Michelle K. Lee
*Director of the United States Patent and Trademark Office*